US005877674A

United States Patent [19]

Berger, II

[11] Patent Number: 5,877,674

[45] Date of Patent: Mar. 2, 1999

[54] RESISTOR WITH ELONGATED RESISTOR ELEMENT PANELS

[75] Inventor: Robert E. Berger, II, Batavia, Ohio

[73] Assignee: Post Glover Resistors Inc., Erlanger, Ky.

[21] Appl. No.: 712,863

[22] Filed: Sep. 12, 1996

[51] Int. Cl.[6] ..... H01C 1/01

[52] U.S. Cl. ..... 338/315; 338/280; 338/281; 338/283; 338/50; 338/53

[58] Field of Search ..... 338/279, 280, 338/281, 283, 284, 291, 315, 316, 318, 319, 50, 51, 53, 57, 58

[56] References Cited

U.S. PATENT DOCUMENTS

| | | | |
|---|---|---|---|
| 841,054 | 1/1907 | Sawyer | 338/280 |
| 1,184,706 | 5/1916 | Keller . | |
| 1,240,457 | 9/1917 | Keller . | |
| 1,352,367 | 9/1920 | Keller . | |
| 1,719,179 | 1/1929 | Sawyer | 338/284 |
| 1,861,434 | 1/1932 | Campbell | 338/318 |
| 2,128,222 | 8/1938 | DuBois . | |
| 2,277,912 | 3/1942 | Johnson et al. . | |
| 2,736,785 | 2/1956 | DuBois | 338/58 |
| 2,868,937 | 1/1959 | Charbonneau | 338/287 |
| 2,969,516 | 1/1961 | Du Bois | 338/284 |
| 3,212,045 | 10/1965 | Weyenberg | 338/316 |
| 3,550,058 | 12/1970 | DuBois, Jr. . | |
| 4,011,395 | 3/1977 | Beck | 373/134 |
| 4,100,526 | 7/1978 | Kirilloff et al. . | |
| 4,146,868 | 3/1979 | Kirilloff et al. . | |
| 4,316,172 | 2/1982 | Luy . | |
| 4,568,908 | 2/1986 | Laskaris et al. . | |
| 4,651,124 | 3/1987 | Kirilloff et al. . | |
| 4,654,627 | 3/1987 | Harkness . | |
| 4,837,549 | 6/1989 | Kirilloff et al. . | |
| 4,847,585 | 7/1989 | Kirilloff et al. . | |
| 5,045,831 | 9/1991 | Kirilloff et al. . | |
| 5,049,851 | 9/1991 | Kirilloff et al. . | |
| 5,157,373 | 10/1992 | Bertram et al. | 338/319 |
| 5,159,310 | 10/1992 | Cummins et al. | 338/280 |
| 5,281,944 | 1/1994 | Kirilloff et al. . | |
| 5,304,978 | 4/1994 | Cummins et al. | 338/280 |
| 5,396,214 | 3/1995 | Kumar . | |

FOREIGN PATENT DOCUMENTS

| | | | |
|---|---|---|---|
| 1126531 | 3/1962 | Germany | 338/316 |
| 27922 | 11/1909 | United Kingdom | 338/284 |
| 190902 | 1/1923 | United Kingdom | 338/280 |
| 317517 | 8/1929 | United Kingdom . | |
| 386081 | 1/1933 | United Kingdom . | |
| 0535157 | 3/1941 | United Kingdom . | |
| 562904 | 7/1944 | United Kingdom | 338/280 |
| 1036129 | 7/1966 | United Kingdom . | |

OTHER PUBLICATIONS

International Search Report for PCT/US97/16098.
Schematic Drawing of a Prior Resistor and Inventors declaration explaining same.

*Primary Examiner*—Michael L. Gellner
*Assistant Examiner*—Karl Easthom
*Attorney, Agent, or Firm*—Dinsmore & Shohl LLP

[57] ABSTRACT

A resistor comprising a substantially continuous resistor element being formed into a plurality of element panels with each panel having at least two holes provided therein. Adjacent element panels are connected in series by a bend in the resistor element. At least two support tubes comprising an insulating material are provided to support the resistor element. A plurality of conductive washers are provided adjacent each hole on both sides of each element panel to provide a conductive heat sink near each support tube hole in the element panels. Insulating washers are spaced between adjacent conductive washers. Two end walls are provided adjacent opposing sides of the resistor element to receive the support tubes.

20 Claims, 2 Drawing Sheets

RESISTOR WITH ELONGATED RESISTOR ELEMENT PANELS

TECHNICAL FIELD

The present invention relates to resistors with elongated element panels with support tubes being placed through the element panels; and, more particularly, to a resistor having a plurality of insulating support tubes running through and supporting each element panel, with conductive washers in electrical communication with the both sides of each element panel adjacent each support tube hole, adjacent conductive washers being spaced apart by an insulating washer.

BACKGROUND OF THE INVENTION

Resistors are used in a variety of commercial applications where it is necessary to convert excessive amounts of electrical energy to thermal energy. The thermal energy can be dissipated through the use of a forced cooling mechanism. Subway cars, trains and other large transportation vessels are among the many applications for resistors as described herein.

More particularly, resistors can be used to dissipate electrical energy generated by electrical motors which drive the wheels of large cargo trucks, thus, retarding the speed of the wheels. Conventional trucks are typically propelled by an engine which directly drives the wheels, and pad or disk brakes are used to stop or slow the vehicle. However, it is often necessary, for example, in mining operations, for a truck carrying large loads, i.e., ore, to repetitively carry those loads down steep grades. The disk or pad brakes as used on a conventional truck are quickly worn under such conditions.

Thus, mining trucks are typically outfitted with a diesel engine which drives individual electrical motors to propel individual wheels. As the truck goes down the side of a large hill or mountain the electrical motors retard the movement of each wheel thereby generating large amounts of current. The current is transmitted through electrical conductors to a bank of resistors where the current is transformed to thermal energy. Thermal energy is dissipated through forced cooling of the resistor elements.

Such resistors are often subjected to extremely harsh conditions and must be relatively substantial in construction and design to withstand the harsh operating conditions. Resistors often operate at temperatures of about 500° C. and are frequently used on trucks which traverse unimproved roads, for example, in a mountain mine or logging area. Thus, resistors must be capable of withstanding severe conditions.

Other design considerations must also be taken into account when designing a resistor. For example, it is desirable to maximize the amount of surface area of the resistor elements within each resistor. For a given material of a given thickness, the amount of electrical energy which can be transformed to thermal energy and dissipated increases as the surface area of the resistor element increases. However, it is often necessary to force cool the resistor elements to continuously remove the thermal energy from the surface of the resistor elements. Forced cooling generally requires a gap or spacing between individual panels of each resistor element. Thus, the resistor element within the resistor volume must be carefully designed to maximize surface area of the resistor element while at the same time providing sufficient air flow through the resistor elements for cooling purposes. Additionally, the resistor elements must be properly supported to maintain structural integrity under harsh working conditions.

In the past, individual resistor plates have been used wherein the ends of the resistor plates were connected in series to form a stack of spaced resistor elements. This conventional configuration has at least two major flaws, both occurring at the connection between individual panels. The panels were typically spot welded. This created localized areas of overheating because the connection between the panels was not uniform. Additionally, the current traveling down one element had to make a 180° turn to travel up the second element. This transition occurred in a very short and abrupt manner at the connection of the two panels.

To alleviate the problems associated with individual element panels, some resistor manufacturers have used thin resistor elements bent into a fan fold continuous resistor configuration. The fan fold resistor element eliminated the need for welding or otherwise connecting individual element panels and allowed for a smooth transition from one panel to another. The transition between panels generally occurred over a smooth substantially "U" shaped bend at the end of each element panel. However, the fan fold resistor element configuration proved to be physically unstable. As the length of each individual element panel, i.e., the distance between the "U" shaped bends increased, so did the failure rate of the resistors due to the instability of the individual element panels. The instability was generally caused by movement of the element panels as the element panels reached operating temperatures and became soft and/or pliable. This problem was dealt with in the past by making the length of the individual panel members shorter and supporting the ends of the resistor element bends.

U.S. Pat. No. 4,100,526 which issued to Kirilloff et al., is typical of grid resistors of the past which utilized fan fold resistor elements. As can be seen, the Kirilloff et al. resistor utilizes eight individual fan folded resistor elements. Approximately every other "U" shaped bend between resistor element panels is supported by a bar running between the individual resistor elements. The support bars running between resistor elements are nonconductive and do not provide any resistance, i.e., they are not part of the element and serve only as support. The eight individual resistor elements are connected in series at their ends. Thus, a considerable amount of the resistor space is consumed by support bars which are not resistive, take up considerable space, add weight and are relatively intricate in design and manufacture. Additionally, because the individual resistor elements are connected in series at their ends, there are 16 connections providing multiple points for failure. Also the individual connections are heavier and more substantial than the thin resistor element, thus, the connections also add considerable weight to the overall resistor product.

There has been a continuing need for resistor elements which are light weight, easy and relatively inexpensive to manufacture and utilize elongated element panels to eliminate the need for multiple elements. Additionally, there is a need for the elimination of the supports for the individual bends of the resistor element due to the complexity, and added weight and cost of the bend supports.

SUMMARY OF THE INVENTION

Accordingly, it is an object of the present invention to obviate the problems discussed above. It is a related object of the present invention to provide a resistor which utilizes a resistor element which is substantially continuous fan folded.

It is an additional object of the present invention that the individual element panels of the resistor element be supported by means other than supporting the ends of the panels.

It is also an object of the present invention that the resistor elements, and resistor using the elements of the present invention be made of commonly available resistive and insulating materials so that the resistor can be easily and economically produced.

Accordingly, the invention, in one embodiment, comprises a resistor which comprises a resistor element which is substantially continuous and fan folded creating a plurality of element panels. The element panels are connected in series to adjacent panels by the bands in the resistor element. Support rod are placed through the element panels through holes provided in each element panel. A plurality of conductive washers are placed in electrical communication with each element panel adjacent the support tube holes to provide a conductive heat sink around each support tube hole. Adjacent conductive washers between element panels are spaced apart by an insulating washer.

In a preferred embodiment of the present invention, the ends of each support rods is supported by resistor end walls wherein at least one of the support rods are free to move within slots provided in the resistor end walls. In an especially preferred embodiment of the present invention, stiffening embossers are formed into each element panel adjacent the side edge. Even more preferably, two stiffening embossers are used, one adjacent either side edge of the element panel and the stiffening embossers are substantially the same length as element panels.

The resistor and resistor elements of the present invention provide significant advantages over the prior art. The resistor of the present invention utilizes one substantially continuous fan folded resistor element having elongated element panels. Additionally, by eliminating the need for end supports, for the bent portion between individual element panels, the resistor is substantially less complicated and substantially less expensive to manufacture and maintain as compared to prior resistors of similar size. Moreover, by eliminating extraneous end supports and connectors between multiple resistor elements, the overall surface area of the resistive element can be increased within a given resistor volume.

BRIEF DESCRIPTION OF THE DRAWINGS

While the specification concludes with the claims particularly pointing out and distinctly claiming the present invention, it is believed that the same will better be understood from the following description taken in conjunction with the accompanying drawings in which:

FIG. 3 is a partial schematic cross-sectional view of a support tube and resistor element panels with conductive and insulting washers spaced there between.

DETAILED DESCRIPTION

Figure 1:
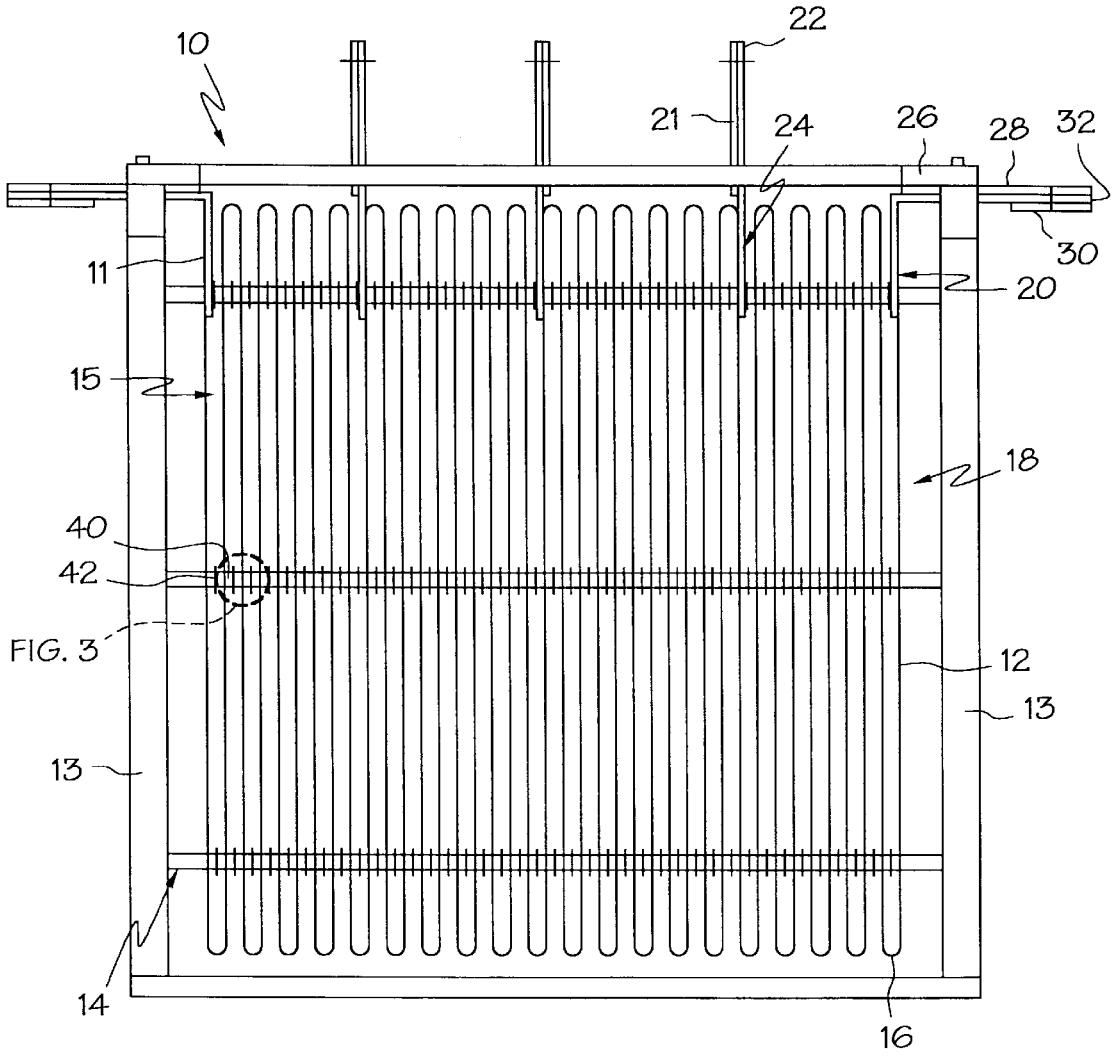
FIG. 1 is a schematic frontal view of a resistor according to the present invention.

Referring now to the drawings in detail wherein FIG. 1 is a schematic frontal view of a resistor 10 according to the present invention. Resistor 10 comprises a resistor element 18 which is fan folded, forming resistor element bends 16. Between resistor element bends 16 are resistor element panels 12.

Figure 2:
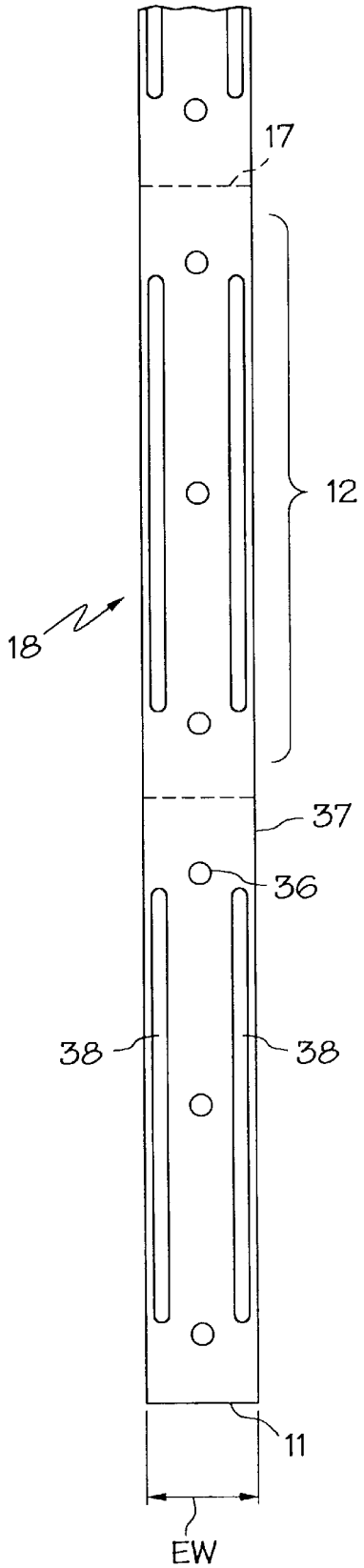
FIG. 2 is a partial schematic plan view of a resistor element of the present invention prior to bending and assembly.

As can be seen in FIG. 2, resistor element 18 can be formed of a long flat resistive material which can be bent along bend line 17, thus forming element panel 12. In the preferred embodiment of the present invention shown in FIG. 1, the bends 16 between element panels 12 are substantially "U" shaped. As was discussed briefly above, it is preferred to have a smooth transition between adjacent element panels (e.g., 12) so that the change in current direction is relatively smooth. The smooth transition between element panels minimizes localized over heating at the bends 16 of element 18.

Support tube 14 is shown traversing individual element panels 12 to support the entire resistor element 18, without the need for supports at bends 16. While support at the element bends 16 is generally not required and may not be preferred, support at the ends can be used if desired or required in extreme conditions.

Support arm 32 is utilized to support the resistor 10 during operation. It is understood that the dimensions of resistor 10 are dictated by the operational environment of resistor 10. The operational environment of resistor 10 is determined by, for example, the designer of the equipment which will utilize the resistor 10. For example, a truck or locomotive manufacturer will design a resistor bank and position it in the vehicle and the resistor manufacturers must then design the resistors (e.g., 10) to fit within that bank. Thus, the exterior dimensions of a resistor (e.g., 10) are typically dictated to, and not controlled by, the resistor (e.g., 10) manufacturer.

A typical resistor bank holds a series of pairs of resistors. For a large-earth moving vehicle, the resistor bank might incorporate 12 pairs of resistors, i.e., 24 resistors (e.g., 10). Ultimately, the manufacturers and designers of the resistors are required to design their resistor to fit into a predetermined environment.

Fortunately, however, the resistor industry has developed numerous standard sizes and shapes to facilitate easy design and manufacture of both new and replacement resistors (e.g., 10). Thus, the size, shape and placement of support arms 32 is relatively standardized and dictated by the original equipment manufacturer of the machine which utilizes the resistor 10. Likewise, terminals 22, which provide electrical connection from the resistor element 18 to the equipment utilizing resistor 10, are relatively standardized. The design, number and placement of terminals 22 will be in a large part dictated by the equipment manufacturer.

Terminals 22 and support arms 32 are both preferably made of stainless steel and are generally thicker than the resistor element 18. Terminals 22 and support arms 32 can be used to connect resistor 10 to an electrical device (not shown), such as an electrical motor. Terminal members 21 and 28 are arranged in electrical communication with terminals 22 and support arms 32 respectively, to minimize overheating at the point where terminals 22 and support arms 32 are connected to an electrical device. Welding, clamping, bolting and other means of attachment are appropriate for connections 24 and 20, although it is preferred that the connection be uniform to avoid localized overheating at individual connection points. Conductive element 30 serves as a spacer to properly adjust the height for mounting resistor 10.

Resistor element 18 can be made of any commercial available resistive material. Stainless steel alloys which comprise, for example 406 stainless steel, aluminum and chromium are preferred. It is understood that whereas lower grades of stainless steel, for example 304 stainless steel, can be used, the resistivity of some lower grades of stainless steel is lower, thus requiring a thinner resistor element to provide the same resistance level when compared to resistor elements made of material having a higher resistance value. Thinner resistor elements decrease the weight and surface area of the resistor. Higher priced alloys with higher resistive values can be used to increase the overall resistance of resistor 10, however, the increase in resistance comes with the corresponding increase in price. Thus, construction material for resistor element 18 is generally selected based upon an optimization of weight, resistance value, cost of materials, and customer preference. It is understood that most resistive materials are appropriate for use for resistor element 18 of the present invention.

As was discussed briefly above, past resistors were made utilizing multiple resistor elements having relatively short element panels. The resistor elements of the past typically had a ratio of the length of the element panel, for example 12, to the width, for example EW, FIG. 2, of less than about 3:1. A typical element panel for continuous fan folded resistor elements of the past were less than about 25 cm in length. As the ratio of the panel length to the element width increases, the likelihood that adjacent element panels will deform during use and contact one another, thus short circuiting the resistor, increases significantly. The ratio of element panels 12 to element width EW of the present invention is preferably greater than about 4:1, and even more preferably, greater than about 6:1.

Figure 3:
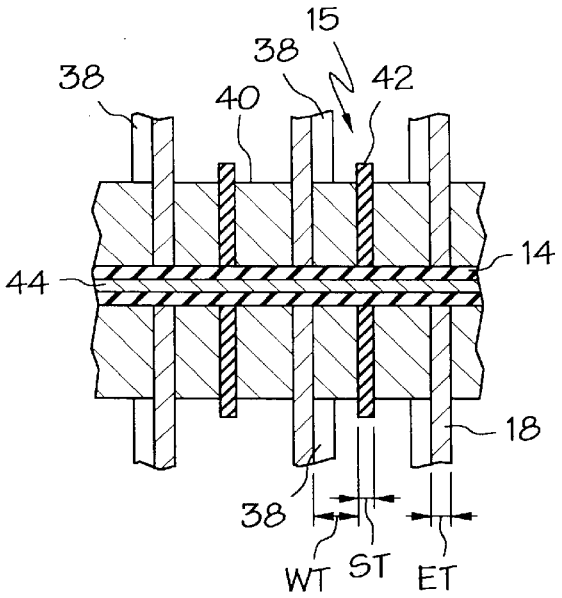

The ability to elongate element panel 12 with respect to the element width EW is accomplished through the use of support rods 14, conductive washers 40 and insulating washers 42 as is shown in FIG. 1, and, is more clearly shown in the cross-sectional view of FIG. 3. Preferably the element panels 12 are at least about 35 cm long, and more preferably, greater than about 40 cm long.

Stiffening embossers 38, as shown in FIG. 2, are adjacent element edge 37 and run substantially the length of each element panel 12. Stiffening embossers 38 assist the element panel 12 in retaining its substantially flat configuration. The substantially flat configuration of element panel 12 is generally preferred to ensure uniform and an adequate space 15 between adjacent element panels 12. As will be discussed in greater detail below, the support rods 14, conductive washers 40, insulating washers 42 and stiffening embossers 38 work in concert to maintain the substantially flat configuration of each individual element panel 12 and to maintain spacing between adjacent panels.

Support rod 14 comprises an insulating exterior so that adjacent element panels 12 are not in electrical communication with one another except at their ends 16. Allowing adjacent element panels 12 to communicate electrically with one another at any point other than at bends 16 would allow electrical current to circumvent portions of the resistor element (e.g., 18) reducing the overall efficiency of resistor 10. Thus, as discussed above, each resistor element panel 12 is connected in series to the adjacent element panel (e.g., 12) by bend 16. It is preferred, to maximize the efficiency of resistor 10, that bend 16 be the only electrical communication between adjacent element panels 12.

Support tube holes 36 are provided in each element panel 12 so that when resistor element 18 is bent about bend line 17, support tube holes 36 align between adjacent element panels 12. Thus, support tubes 14 can traverse and support each element panel 12 of resistor element 18. It is generally preferred that the outside dimensions of support tube 14 be substantially equal to the dimensions of support tube holes 36. Support tube 14 can be circular, triangular, square or other cross-sectional geometric configurations. Support tubes 14 are shown as circular in the preferred embodiment shown in FIGS. 1 through 4, although other geometrical cross-sectional configurations are equally acceptable. Support tubes 14 are preferably made of a high temperature insulating material. Mica, which can withstand temperatures of up to about 500° C. is preferred, and mica which can withstand temperatures of up to about 600° C. is especially preferred. Other insulating materials can be used.

As can be understood, it may be preferred in some instances to provide a solid core 44 within insulating support tubes 14. The insulating material used to form the exterior of support tubes 14 may not have sufficient structural integrity to support resistor element 18. The strength of support tubes 14 can be increased by encasing a core 44 in insulating material. Core 44 can be any available material, but it is preferably a material that is stronger than the insulating material. Core 44 can be a metal rod, threaded rod of virtually any other material that can be coated with an insulator and will fit through the support tube holes after being insulated.

As can be appreciated, support tube holes 36 reduce the cross section and surface area of resistor element 18 adjacent support tube holes 36. The reduction in cross section and surface area of resistor element 18 generally causes localized areas of overheating during operation of the resistor 10. The localized areas of overheating can cause failure of the resistor element 18 adjacent support tube holes 36. To minimize the effects of localized overheating, conductive heat sink washers 40 are provided adjacent support tube holes 36. Conductive heat sink washers 40 are positioned in electrical communication with resistor element 18 and are preferably provided on both sides of each resistor panel 12 adjacent each support tube hole 36.

The conductive heat sink washers 40 can be spot welded or attached to resistor element 18 by any available means which maintains electrical contact. However, in the preferred embodiment shown in FIGS. 1 and 3, the conductive heat sink washers 40 contact element 18 by compressive forces only. To maintain the electrical segregation between adjacent conductive heat sink washers 40, and subsequently resistor element panels 12, an insulator, preferably an insulating washer 42 is provided between adjacent conductive heat sink washers 40. Insulating washers 42 can be made of any commercially available insulating material such as mica, which can withstand temperatures of greater than about 500° C., and more preferably up to about 600° C.

Likewise, conductive heat sink washers 40 must withstand high temperature and can be made of any commercially available conductive material. The thickness of the heat sink washers WT is generally greater than the thickness of the resistor element ET. The thickness of the insulating washer ST should only be as thick as necessary to maintain electrical segregation between element panels 12 and the conductive heat sink washers 40 spaced therebetween. The conductive heat sink washers 40 are preferably as thick as spacing 15 allows to maximize the amount of heat that can dissipated around support tube holes 36. As was discussed above, space 15 should be minimized to allow for maximum surface area of resistor element 18, while at the same time space 15 must be sufficiently large to allow forced cooling of resistor element 18, and sufficiently large to insure electrical segregation between adjacent element panels. A preferred distance for space 15 is less than about 1.5 cm and more preferably less than about 1.0 cm.

Figure 4:
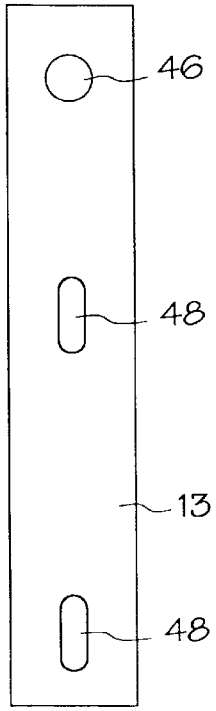
FIG. 4 is a schematic plan view of a resistor end wall of the present invention.

FIG. 4 shows an end wall 13 which is provided with a hole 46 and two slots 48. As is best illustrated in the frontal view of resistor 10, FIG. 1, the three support tubes 14 traverse resistor element 18 with respective opposing ends of each support tube 14 entering into opposing end walls 13. The opposing ends of each support tube 14 enter into either a hole 46 or a slot 48 in opposing end walls 13. Support tube 14 which enters holes 46 of opposing end walls 13 is restricted in its relative movement to end walls 13. However, the remaining support tubes 14 are free to move within slots 48 to accommodate the expansion and contraction of resistor element 18.

The ability of support tubes 14 to move within slots 48 allows element panels 12 to expand and/or contract during operation, primarily due to changes in temperature caused by increases or decreases in current flow through resistor element 18. Without the ability for support tubes 14 to move within slots 48, element panels 12 are prone to buckle under high temperature conditions. Severe buckling of one or more element panels 12 can result in element panels (e.g., 12) touching adjacent panels (e.g., 12) causing a short circuit in resistor element 18. In the preferred embodiment of the present invention shown in FIGS. 1 and 4, a hole 46 and two slots 48 are provided in each end wall 13. However, hole 46 is optional and serves to stabilize resistor element 18. In some instance all of the support tubes 14 may extend through slots 48 to provide more freedom of movement for resistor element 18.

Having shown and described the preferred embodiments of the present invention, further adaptation of the resistor with elongated element panels can be accomplished by appropriate modifications by one of ordinary skill in the art without departing from the scope of the present invention. A number of alternatives and modifications have been described herein and others will be apparent to those skilled in the art. For example, specific methods of manufacturing the resistor and materials of construction have been described, although other manufacturing processes and materials can be used to produce the desired resistor. Accordingly, the scope of the present invention should be considered in terms of the following claims and is understood not be limited to the details of the processes and products shown and described in the specification.

I claim:

1. A resistor comprising:

(A) a plurality of element panels, each having a length and a width, at least two support tube holes being provided in each resistor panel, and adjacent resistor panels being connected in series by a bend;

(B) a support tube having a first axis and oppositely disposed ends and an insulating material provided on an outer surface of the support tube, the support tube extending through one of the support tube holes in each resistor panel;

(C) a plurality of conductive washers, at least one conductive washer being in electrical communication with at least one side of each resistor panel adjacent each support tube hole;

(D) at least one insulator arranged between each adjacent pair of resistor panels; and (E) a pair of end walls, each having a longitudinal axis along its length generally transverse to the first axis and a slot receiving an opposing end of the support tube, wherein each slot permits movement of the support tube along the longitudinal axis of the respective end wall;

(F) an electrical physically contacting at least one of the plurality of element panels.

2. The resistor of claim 1, wherein each slot is oblong shaped.

3. The resistor of claim 1, wherein a ratio of the length to the width of the element panels greater than about 4:1.

4. The resistor of claim 3, wherein the ratio is greater than about 6:1.

5. The resistor of claim 1, further comprising at least one conductive washer in electrical communication with another side of each element panel adjacent each support tube hole.

6. The resistor of claim 1, wherein the resistor element is formed from a stainless steel alloy.

7. The resistor of claim 1, wherein the resistor elements are substantially flat.

8. The resistor of claim 1, wherein each of the plurality of resistor panels comprises at least one stiffening embosser.

9. The resistor of claim 1, wherein the resistor panels are oriented parallel with one another.

10. The resistor of claim 1, wherein the support tubes comprise a hollow mica tube with a solid core of a different material.

11. The resistor of claim 1, comprising an electrical device connected to the electrical terminal.

12. The resistor of claim 1, wherein the length of each of the resistor panels is greater than about 35 cm.

13. The resistor of claim 1, wherein the resistive material withstands temperatures of up to about 500° C.

14. The resistor of claim 1, wherein the bend between adjacent resistor elements comprises a substantially "U" shape.

15. The resistor of claim 1, wherein said end walls prevent movement of said support tube along the first axis relative to said end walls.

16. The resistor of claim 1, wherein the end panels have a length greater than the length of the (extend) plurality of element panels.

17. A resistor comprising:

(A) a plurality of resistor panels, each having a length and a width, at least two support tube holes being provided in each resistor element, and adjacent resistor panels being connected in series by a bend;

(B) first and second support tubes, each having oppositely disposed ends, a first axis, and an insulating material on an outer surface of each support tube, the support tubes extending through one of the support tube holes in each resistor element;

(C) a plurality of conductive washers, at least one conductive washer being in electrical communication with at least one side of each resistor element adjacent each support tube hole;

(D) at least one insulator arranged between each adjacent pair of resistor elements; and (E) a pair of end walls, each having a longitudinal axis alone its length and generally transverse of the first axis, each end wall having a slot receiving an opposing end of the first support tube, wherein each slot permits movement of the first support tube along the longitudinal axis of the respective end wall, and each end wall comprises a hole receiving an opposing end of the second support tube, wherein each hole restricts movement of the second support tube along the longitudinal length of the end walls.

18. The resistor of claim 17, comprising a third support tube having oppositely disposed ends, and an insulating material provided on an outer surface of the third support tube, the third support tube extending through one of the support tube holes in each resistor element, each end wall having a second slot receiving an opposing end of the third support tube, wherein the slot is configured to permit movement of the third support tube along the longitudinal length of the end walls.

19. The resistor of claim 18, wherein the first slot and second slot are positioned adjacent each other on each of the end walls.

20. The resistor of claim 18, wherein each of the first and second slots is oblong shaped.

* * * * *

UNITED STATES PATENT AND TRADEMARK OFFICE

CERTIFICATE OF CORRECTION

PATENT NO. : 5,877,674
DATED : March 2, 1999
INVENTOR(S) : Robert E. Berger, II

It is certified that error appears in the above-identified patent and that said Letters Patent is hereby corrected as shown below:

In column 7, line 47, delete "and".

In column 8, line 23, delete "(extend)".

In column 8, line 43, replace "alone" with --along--.

Signed and Sealed this

Seventeenth Day of August, 1999

*Attest:*

Q. TODD DICKINSON

*Attesting Officer*

*Acting Commissioner of Patents and Trademarks*